United States Patent [19]

Farmer

[11] 4,221,120

[45] Sep. 9, 1980

[54] MULTIPLE NEEDLE CYLINDER HOSIERY KNITTING MACHINE

[76] Inventor: Glen R. Farmer, 200 Midway Dr., Spartanburg, S.C. 29301

[21] Appl. No.: 957,170

[22] Filed: Nov. 2, 1978

[51] Int. Cl.[2] ..... D04B 9/28; D04B 15/68; D04B 15/80; D04B 15/61

[52] U.S. Cl. ..... 66/222; 66/8; 66/134; 66/139; 66/234

[58] Field of Search ..... 66/8, 9 A, 133, 138, 66/139, 215, 216, 222, 234, 134

[56] References Cited

U.S. PATENT DOCUMENTS

| | | | |
|---|---|---|---|
| 334,338 | 1/1886 | Branson | 66/234 X |
| 1,207,757 | 12/1916 | Houseman | 66/234 X |
| 1,359,250 | 11/1920 | Houseman | 66/231 X |
| 1,443,999 | 2/1923 | Merli et al. | 66/9 A |
| 1,517,698 | 12/1924 | Bauer | 66/8 |
| 2,381,641 | 8/1945 | Bromley et al. | 66/231 X |
| 3,221,516 | 12/1965 | Giuiuzza et al. | 66/8 |
| 3,460,160 | 8/1969 | Sangiacomo | 66/133 |
| 4,151,729 | 5/1979 | Micheletti | 66/216 |

FOREIGN PATENT DOCUMENTS

| | | | |
|---|---|---|---|
| 2732033 | 2/1978 | Fed. Rep. of Germany | 66/138 |
| 1585268 | 1/1970 | France | 66/8 |
| 500189 | 11/1954 | Italy | 66/8 |
| 624203 | 8/1961 | Italy | 66/8 |

*Primary Examiner*—Wm. Carter Reynolds
*Attorney, Agent, or Firm*—Bell, Seltzer, Park & Gibson

[57] ABSTRACT

This multiple needle cylinder hosiery knitting machine is provided with a single horizontally disposed pattern disc surrounding the needle cylinders and controlling the simultaneous knitting of a sock on each of the needle cylinders. All of the instrumentalities used in knitting a sock at each needle cylinder, such as the yarn feed fingers, yarn cutters, the needle selecting devices, etc., are controlled by cams on the pattern disc. Drive means is provided for imparting step-by-step movement to the single pattern disc and a pattern chain controls movement of the pattern disc. Easy access is provided to the pattern disc and to each of the needle cylinders for changing patterns, cleaning and lubricating, for replacing parts, and for making other adjustments and repairs to the machine.

8 Claims, 17 Drawing Figures

MULTIPLE NEEDLE CYLINDER HOSIERY KNITTING MACHINE

FIELD OF THE INVENTION

This invention relates generally to a multiple needle cylinder hosiery knitting machine and more particularly to a four needle cylinder machine with means for simultaneously knitting a sock on each of the needle cylinders. A single horizontally disposed pattern disc surrounds the four needle cylinders and controls the knitting of the socks on each needle cylinder.

BACKGROUND OF THE INVENTION

It is known to provide a plurality of needle cylinders on a single frame for simultaneously knitting a plurality of tubular articles, such as socks. These prior types of multiple cylinder knitting machines are usually provided with a single drive motor for rotating all of the needle cylinders at the same rotational speed. However, it is the usual practice to provide individual pattern control means at each of the needle cylinders for controlling the various instrumentalities used in knitting the socks, such as the yarn feed fingers, the yarn cutter and clamp, the needle selecting guides, etc. The provision of individual pattern control means can result in improper timing of one or more of the needle cylinders and can result in damage to the machine. Also, the provision of individual pattern control means for each cylinder requires additional drive means for each of the pattern control means. The provision of individual pattern control means and individual drives therefore results in more complicated mechanism for controlling the various elements of each of the knitting cylinders and also increases the size of the machine.

SUMMARY OF THE INVENTION

With the foregoing in mind, it is an object of the present invention to provide a multiple cylinder hosiery knitting machine wherein the needle cylinders are supported for vertical rotation about a vertical axis and in closely spaced relationship with a single horizontally disposed pattern disc surrounding and rotating around the needle cylinders for controlling the operation of each of the needle cylinders. This arrangement of the needle cylinders and the single pattern disc reduces the size of the knitting machine, prevents improper timing, and simplifies the operation of the control mechanisms so that increased production is possible without excessive increases in the speed of operation of the machine.

According to the present invention, four needle cylinders, with the associated instrumentalities for forming an individual sock at each needle cylinder, are supported for rotation about spaced-apart vertical axes. The needle cylinders are equally spaced from each other and are positioned in each quadrant of a circle. The single horizontally disposed pattern disc surrounds the four needle cylinders and is supported for rotation with cams supported in annular races on the pattern disc. Suitable linkage is operated by the cams on the pattern disc for operating the various instrumentalities used in knitting a sock at each needle cylinder, such as the yarn feed fingers, yarn cutters, the needle selecting devices, etc. Drive means is provided for imparting step-by-step movement to the single pattern disc and a pattern chain controls movement of the pattern disc. The cams are arranged on the pattern disc so that the knitting of a sock on each needle cylinder is completed each time the pattern disc moves one-fourth of a complete rotation. This arrangement provides easy access to the pattern disc and to each of the needle cylinders, for changing patterns, cleaning and lubricating, for replacing parts, or making other adjustments and repairs to the machine.

BRIEF DESCRIPTION OF DRAWINGS

Other objects and advantages will appear as the description proceeds when taken in connection with the accompanying drawings, in which.

DESCRIPTION OF THE ILLUSTRATED EMBODIMENT

Figure 2:
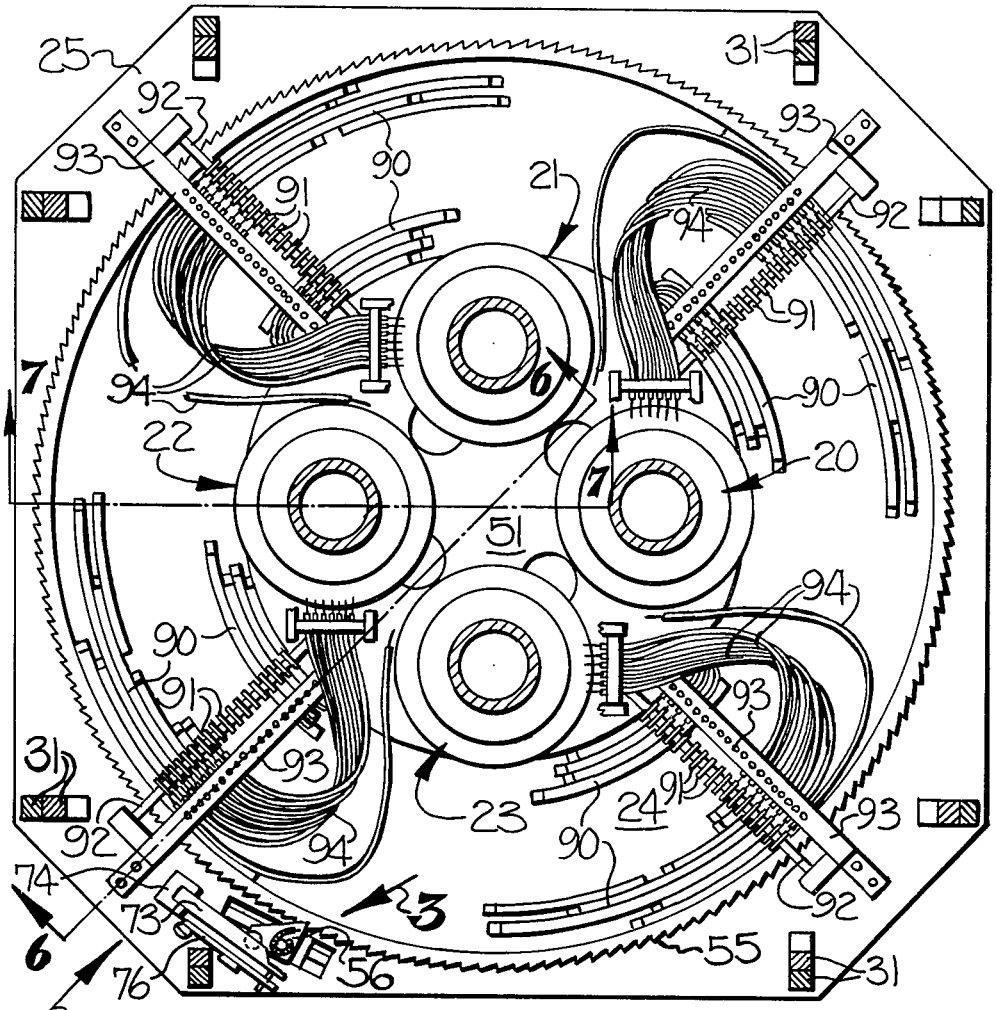
FIG. 2 is a sectional plan view taken substantially along the line 2—2 in FIG. 1.
Figure 5:
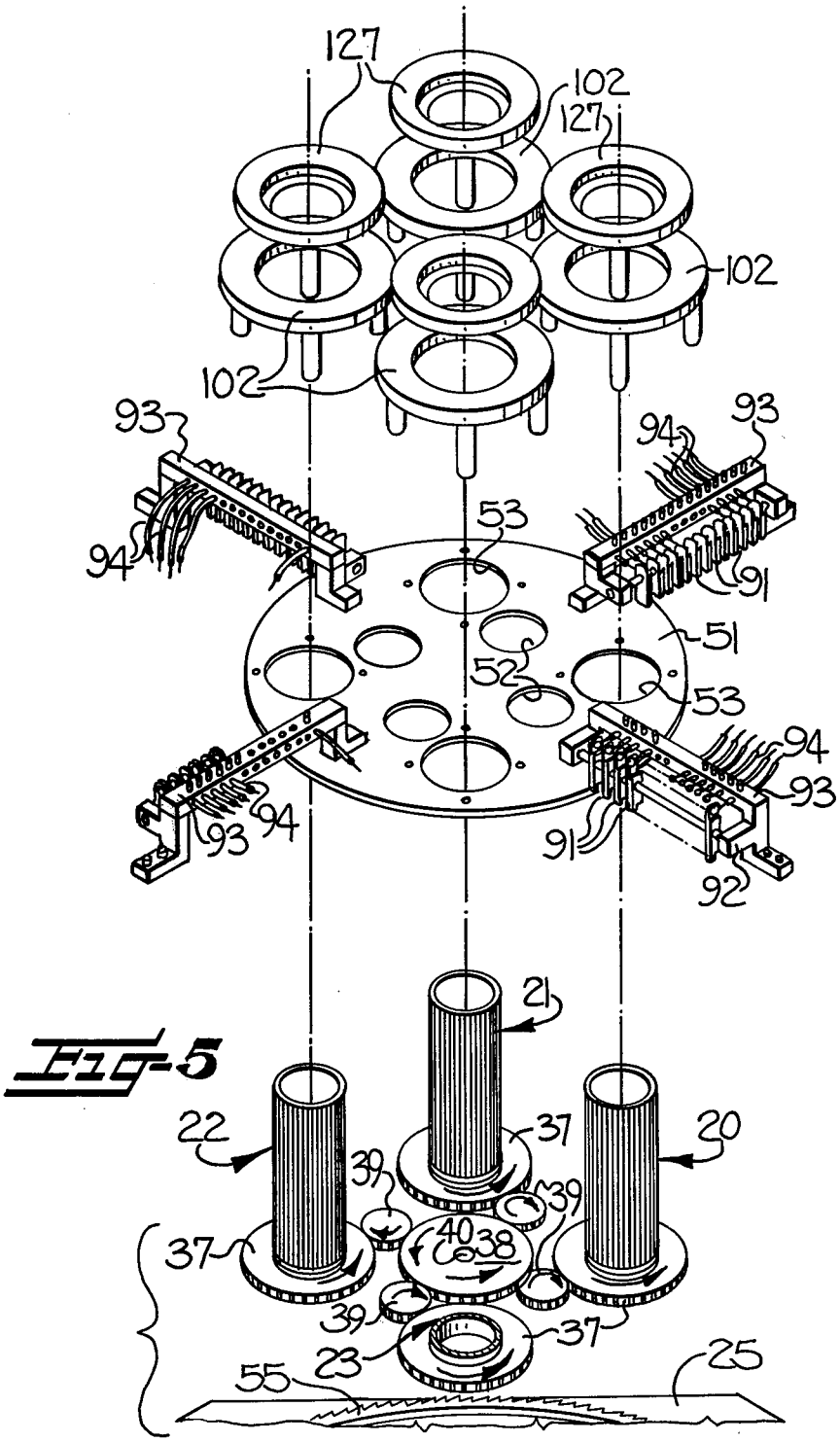
FIG. 5 is an exploded isometric view illustrating the arrangement of the four needle cylinders and associated parts and a portion of the drive means therefor.
Figure 5A:
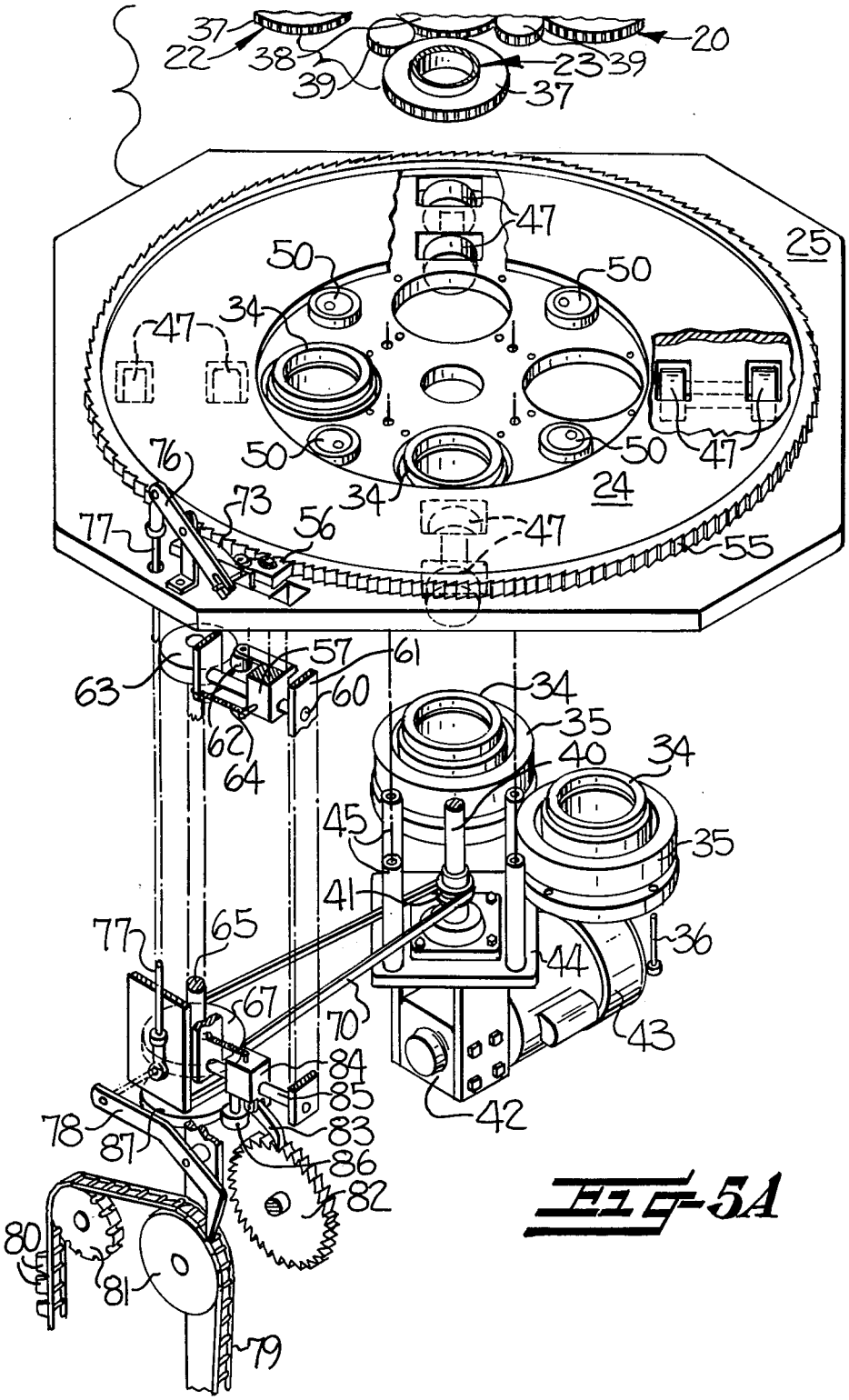
FIG. 5A is a view similar to FIG. 5 but illustrating the arrangement of the single horizontally disposed pattern disc surrounding the four needle cylinders and the control for imparting selected step-by-step movement thereto.

Generally, the machine of the present invention includes four needle cylinders, broadly indicated at 20–23 in FIG. 2, each supported for rotation about a vertical axis. The needle cylinders 20–23 are equally spaced apart in a circle and in 90 degree relationship to each other. The needle cylinders 20–23 are identical and are provided with the necessary instrumentalities, to be later described, for simultaneously knitting a tubular article, such as a sock or other hosiery article at each needle cylinder. Drive means, illustrated in FIGS. 5 and 5A, is provided for simultaneously rotating the needle cylinders 20–23 at the same rotational speed.

Figure 3:
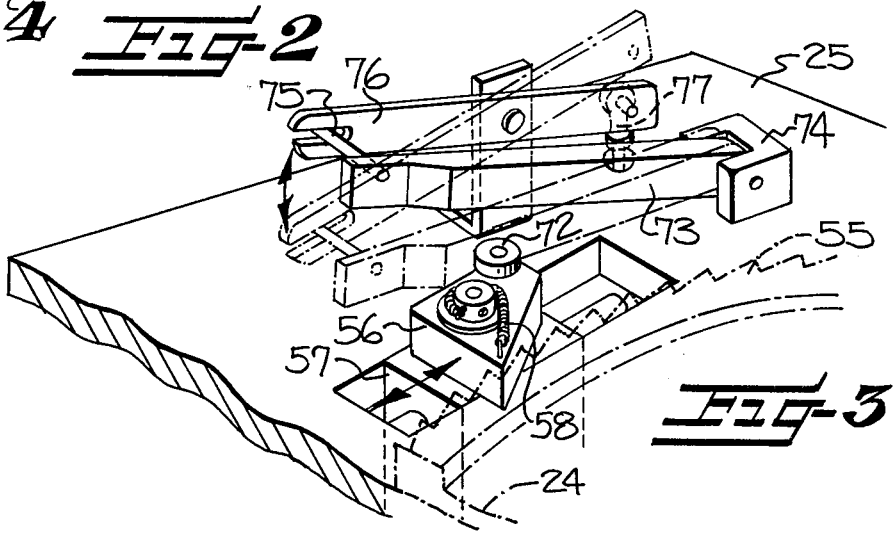
FIG. 3 is an enlarged fragmentary isometric view looking in the direction of the arrow 3 in FIG. 2 and illustrating a portion of the mechanism for controlling the operation of the racking pawl for the pattern disc.
Figure 4:
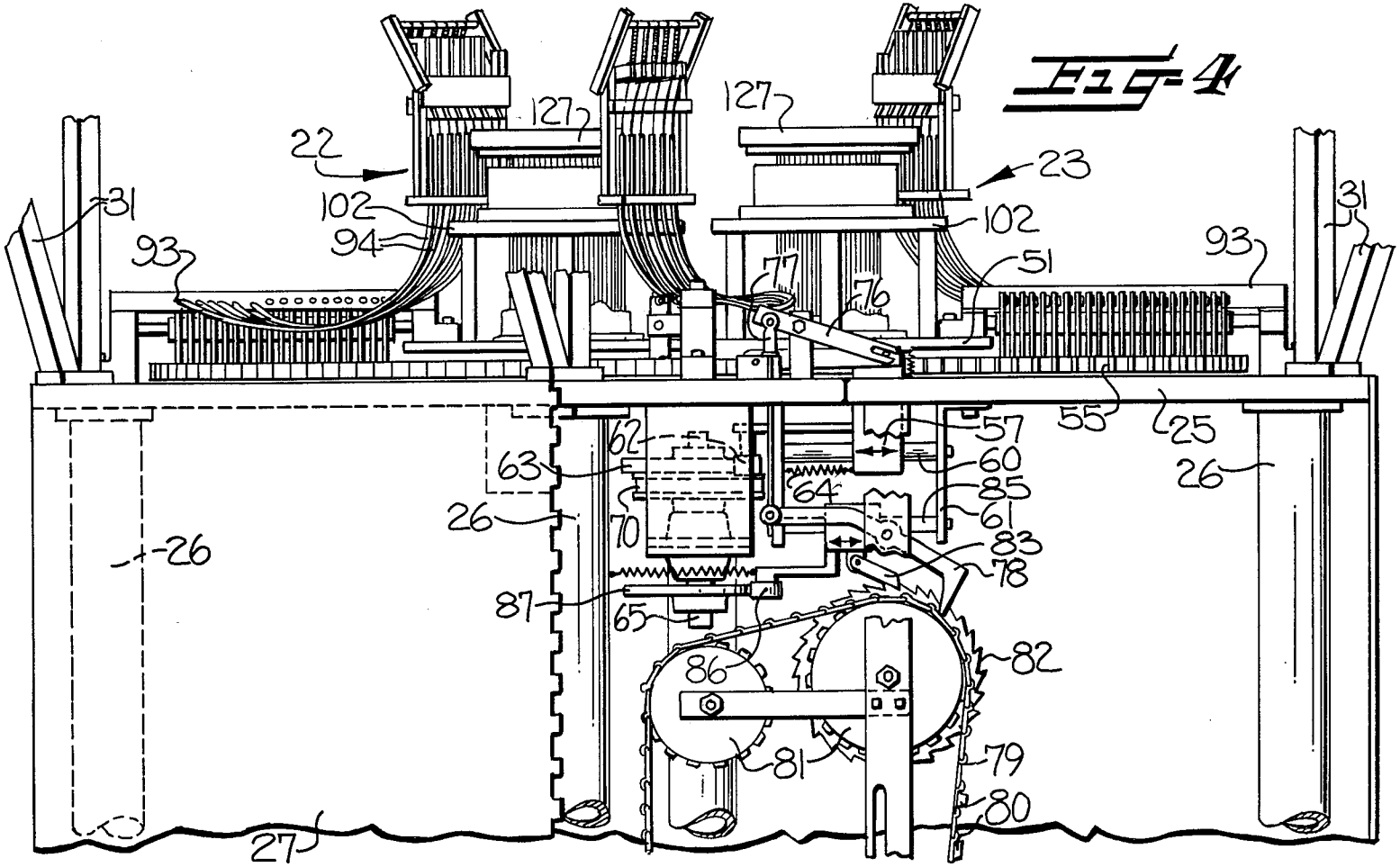
FIG. 4 is a fragmentary elevational view looking inwardly in the direction of the arrow 4 in FIG. 2.

A horizontally disposed pattern disc 24 surrounds the needle cylinders 20–23 and is supported on a base plate 25 (FIG. 5A) for rotation around the needle cylinders. Drive means is provided for imparting rotation to the pattern disc 24 in timed relationship to rotation of the needle cylinders 20–23. The pattern disc drive means is best illustrated in FIGS. 3, 4 and 5A. Cam means (FIG. 2) is supported in annular races on the horizontally disposed pattern disc 24 and linkage means, to be presently described, is operable by the cam means on the pattern disc. The linkage means is operatively associated with the yarn feed means, the needle selector means, and other instrumentalities for controlling the knitting of a sock at each of the needle cylinders 20–23.

Figure 1:
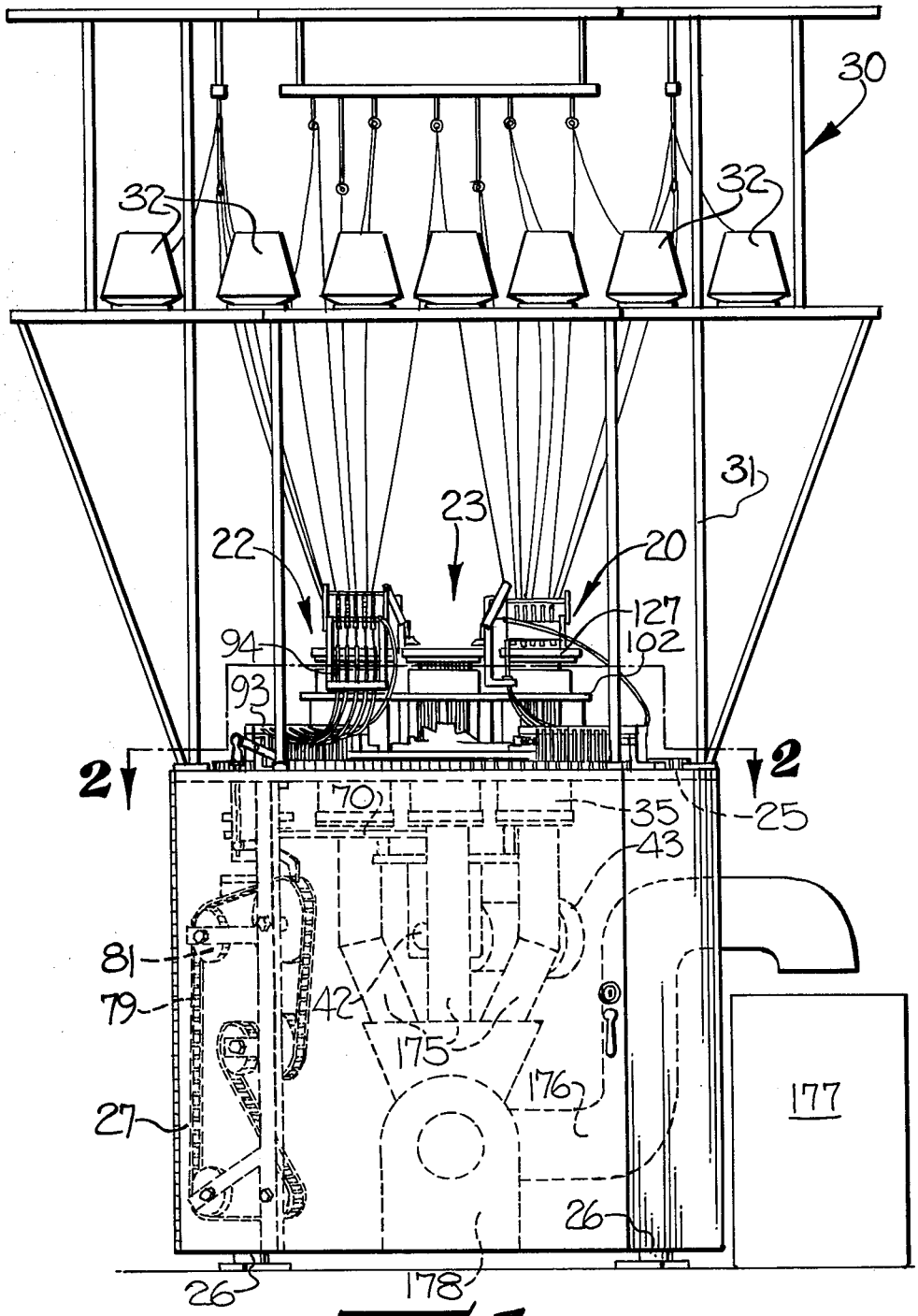
FIG. 1 is a front elevational view of the knitting machine of the present invention.

As illustrated in FIGS. 1 and 4, the base plate 25 is supported in a fixed horizontal position on legs 26 and a suitable housing or skirt 27 surrounds the legs 26 and extends downwardly from the base plate 25. A yarn package supply creel, broadly indicated at 30 in FIG. 1, is supported above the base plate 25 on the upper ends of support legs 31, the lower ends of which are fixed to the base plate 25. Yarn supply packages 32 are supported on the creel 30 and the yarn is withdrawn from the supply packages 32 and directed through suitable guides and downwardly to the four needle cylinders 20–23 in a manner to be presently described.

Each of the needle cylinders 20–23 is supported for driven rotation on the base plate 25. The lower end of the needle cylinder 22 (FIG. 7) is fixed in the upper end of an inner bearing sleeve 34 and suitable bearings are provided between the inner sleeve 34 and an outer bearing sleeve 35 which is in turn fixed to the base plate 25, by bolts 36. A cylinder drive gear 37 is fixed to the upper end of the inner bearing sleeve 34 and is drivingly connected to a main drive gear 38 (FIG. 5) by a removable intermediate drive pinion 39.

Figure 6:
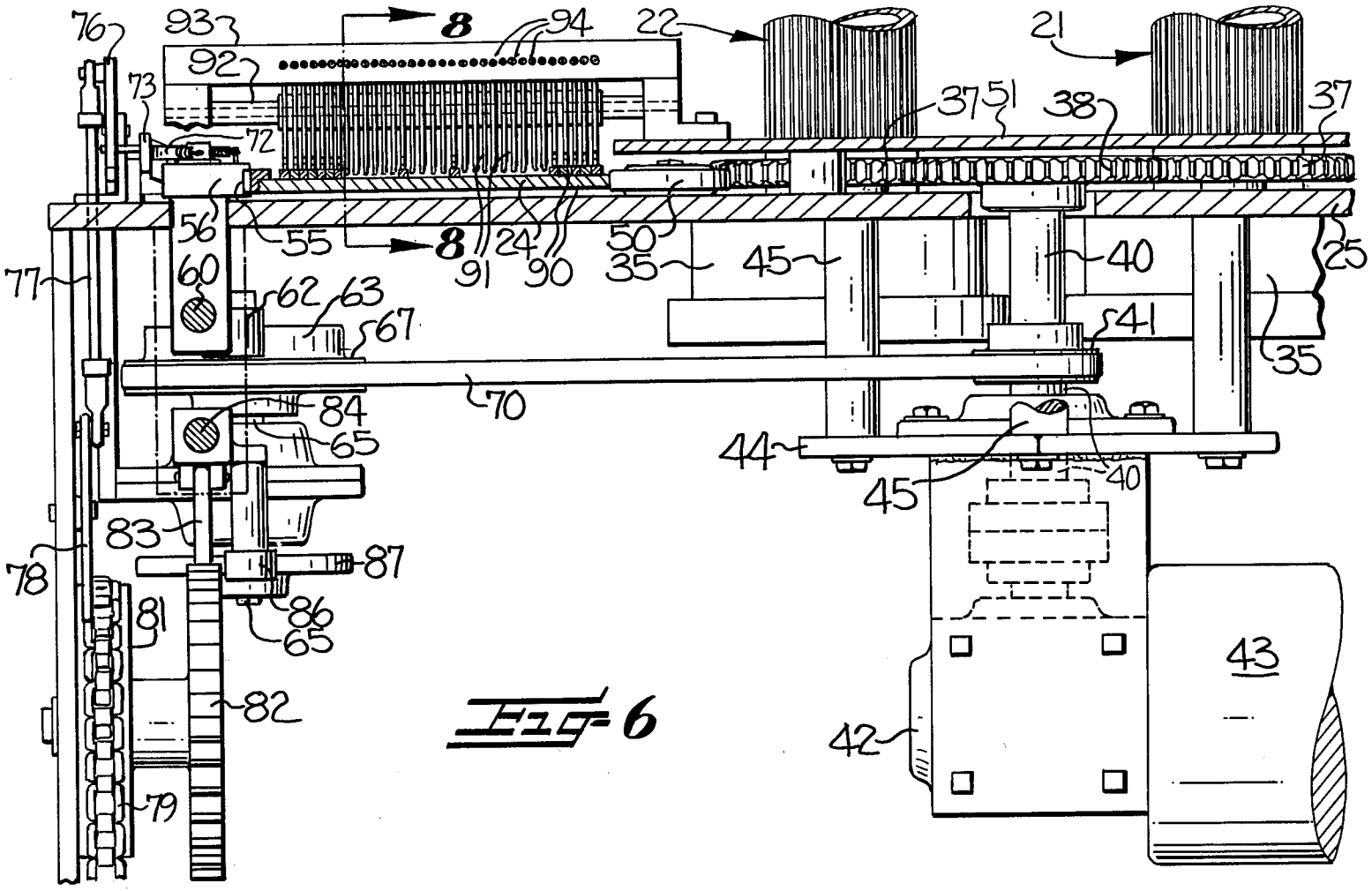
FIG. 6 is an enlarged fragmentary vertical sectional view taken substantially along the line 6—6 in FIG. 2.
Figures 7, 8:
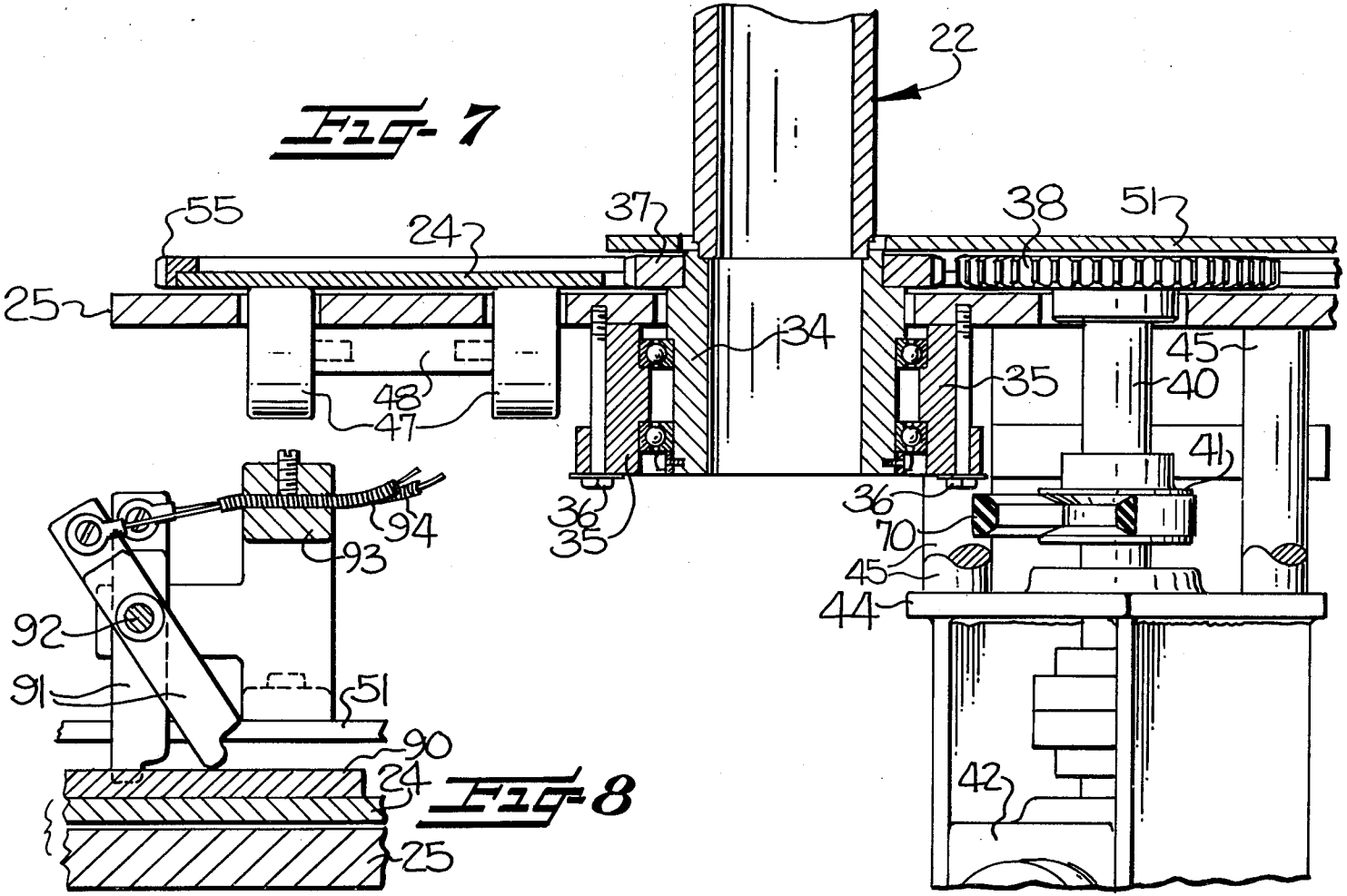
FIG. 7 is an enlarged fragmentary vertical sectional view taken substantially along the line 7—7 in FIG. 2.
FIG. 8 is an enlarged fragmentary vertical sectional view taken substantially along the line 8—8 in FIG. 6.

A drive shaft 40 is fixed at its upper end to the main drive gear 38 and extends through the base plate 25 (FIGS. 6 and 8). The drive shaft 40 is provided with a drive pulley 41 for driving the pattern disc 24, in a manner to be presently described. The lower end of the drive shaft 40 is driven by a gear reduction unit 42 on one end of an electric drive motor 43. The drive motor 43 and gear reduction unit 42 are supported on a bearing housing 44 (FIG. 6) which is in turn supported by posts 45, fixed at their upper end on the lower surface of the base plate 25. The intermediate drive gears 39 are removably supported on the base plate 25 by shoulder bolts so that they can be easily removed if it is desired to idle one or more of the needle cylinders 20–23 while permitting the remaining needle cylinders to continue to rotate. Thus, when the motor 43 is operating, the drive shaft 40 rotates the main drive gear 38 and the needle cylinders 20–23 at the same rotational speed as long as the intermediate drive pinions 39 are in driving position.

As best shown in FIG. 5A, the pattern disc 24 is supported for rotation above the base plate 25 and surrounding the needle cylinders 20–23 by bearing support rollers 47 extending upwardly through suitable slots in the base plate 25 and being rotatably supported on opposite ends of bearing blocks 48. As illustrated in FIG. 7, the upper peripheral surfaces of the rollers 47 engage the lower surface of the pattern disc 24 and rotatably support the same in four equally spaced locations (FIG 5A). The pattern disc 24 is provided with a central opening and four equally spaced-apart bearing rollers 50 are supported on eccentric mounts on the base plate 25 so that the bearing rollers 50 engage the periphery of the central opening in the pattern disc 24. This arrangement maintains the pattern disc 24 in the proper alignment as it rotates around the needle cylinders and the alignment of the pattern disc 24 may be adjusted by adjustment of the eccentric mounts for the bearing rollers 50 (FIG. 5A).

A support plate 51, best illustrated in FIG. 5, is supported in spaced relationship above the base plate 25 and covers the main drive gear 38, the intermediate gears 39, and the gears 37 on the needle cylinders 20–23. Four circular openings 52 are provided in the support plate 51 so that the intermediate drive gears 39 may be selectively removed to idle any one or more of the needle cylinders 20–23. Four circular openings 53 are also provided in the support plate 51 so that the needle cylinders 20–23 can pass upwardly therethrough.

The drive means for imparting rotation to the pattern disc 24 in timed relationship to rotation of the needle cylinders 20–23 includes a racking wheel 55 fixed on the outer periphery of the pattern disc 24 (FIG. 7) and a racking pawl 56 (FIG. 3) adapted to be selectively engaged with the racking teeth on the racking wheel 55. The racking pawl 56 is pivotally supported on a slide block 57 and is normally urged into racking engagement with the racking wheel 55 by a tension spring 58. The slide block 57 extends through a slot in the base plate 25 and is supported for reciprocating sliding movement on a slide rod 60 which is fixed at opposite ends on spaced-apart vertical support plates 61 (FIG. 5A).

A cam follower roller 62 (FIG. 4) is carried by the slide block 57 and is normally urged into engagement with an eccentric cam 63 by means of a tension spring 64. The eccentric cam 63 is fixed on the upper end of a vertical shaft 65 which is supported for rotation in a bearing stand 66. A drive pulley 67 is fixed on the shaft 65 (FIG. 5A) and is drivingly connected by a belt 70 to the drive pulley 41 on the main drive shaft 40 so that continuous rotation is imparted to the shaft 65 and eccentric cam 63 when the motor 43 is operating. Thus, the slide block 57 reciprocates back and forth so that the racking pawl 56 is continuously reciprocated.

Control means is provided for selectively permitting operation of the racking pawl 56 and includes a cam roller 72 (FIG. 3) supported on the racking pawl 56 and positioned to be engaged by a cam lever 73 when lowered to the dash-dot position shown in FIG. 3 so that the pawl 56 is moved in a counterclockwise direction to maintain the racking pawl 56 out of racking engagement with the teeth on the racking wheel 55. One end of the cam lever 73 is pivotally supported on a support bracket 74, fixed on the base plate 25 and the other end is provided with an operating pin 75 extending outwardly therefrom. The free end of the operating pin 75 is positioned in the bifurcated forward end of a control lever 76 which is pivotally supported intermediate its ends and the opposite end is suitably connected to the upper end of a control link 77.

The control link 77 passes downwardly through an opening in the base plate 25 and its lower end (FIG. 5A) is suitably connected to the outer end of a cam lever 78, which is pivotally supported intermediate its ends and the opposite end of which is adapted to ride on one side of a pattern chain 79. One side of the pattern chain 79 is provided with operating pattern lugs 80 positioned in the proper position thereon and the chain 79 is supported for movement on sprockets 81. One of the sprockets 81 has a rack wheel 82 (FIGS. 5A and 6) fixed thereto and one end of a racking pawl 83 is positioned for racking engagement therewith. The other end of the racking pawl 83 is pivotally connected to a slide block 84 supported for reciprocating sliding movement on a slide rod 85.

Opposite ends of the slide rod 85 are fixed in the lower ends of the vertical support plates 61. A cam follower roller 86 is carried by the slide block 84 and is normally urged into engagement with an eccentric cam wheel 87. The cam wheel 87 is fixed on and continuously rotates when the shaft 65 is rotated so that the pawl 83 continuously racks the wheel 82 in a step-by-step manner to thereby move the pattern chain 79 in a continuous step-by-step manner.

When the control lever 78 (FIG. 5A) engages and is raised at its free end by a pattern lug 80 on the pattern chain 79, the operating link 77 is lowered to raise the opposite end of the control lever 76 (FIG. 3) to the solid line position and to also raise the cam lever 73 so that the racking pawl 56 is free to move the racking wheel 55 and pattern disc 24 with each reciprocation of the slide block 57. When the free end of the control lever 78 moves off of the pattern lug 80, the cam lever 73 is lowered to the dash-dot line position shown in FIG. 3 and although continued reciprocation is imparted to the racking pawl 56, it is held out of racking position so that it does not engage the teeth of the racking wheel 55 and no movement is imparted to the pattern disc 24. Thus, the pattern chain 79 controls the step-by-step movement of the pattern disc 24, in accordance with a predetermined pattern formed on the chain 79 by the lugs 80.

Cam means, illustrated in the form of cams 90 (FIG. 2), is supported in annular races on the horizontally disposed pattern disc 24. Linkage means is operated by the cams 90 and is operatively associated with the various instrumentalities of the machine which cooperate to knit a sock, in a manner to be presently described. The linkage means includes a plurality of control levers 91 (FIG. 8) which are pivotally supported intermediate their ends on a pivot shaft 92 supported at opposite ends on a bridging member 93. The outer end of the bridging member 93 is fixed on the base plate 25 and the inner end is fixed on the support plate 51 with the medial portion being supported in spaced relationship above the pattern disc 24. Suitable control cables 94 are connected at one end to the corresponding control levers 91 and the housings of the control cables 94 are fixed in the bridging member 93.

Any number of cam races may be provided along the face of the pattern disc 24 to control the various instrumentalities associated with each of the needle cylinders 20–23 to knit the type of sock desired. The manner in which the control cables 94 operate the various elements will be presently described.

Figure 12:
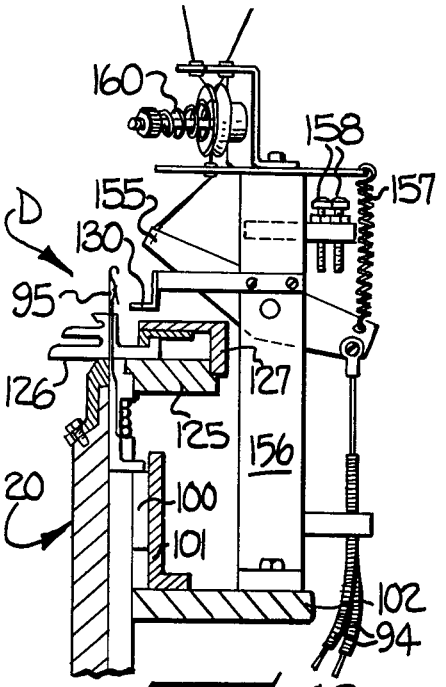
FIG. 12 is a fragmentary vertical sectional view taken substantially along the line 12—12 in FIG. 9 and illustrating the yarn feeding fingers at one knitting station.
Figure 14:
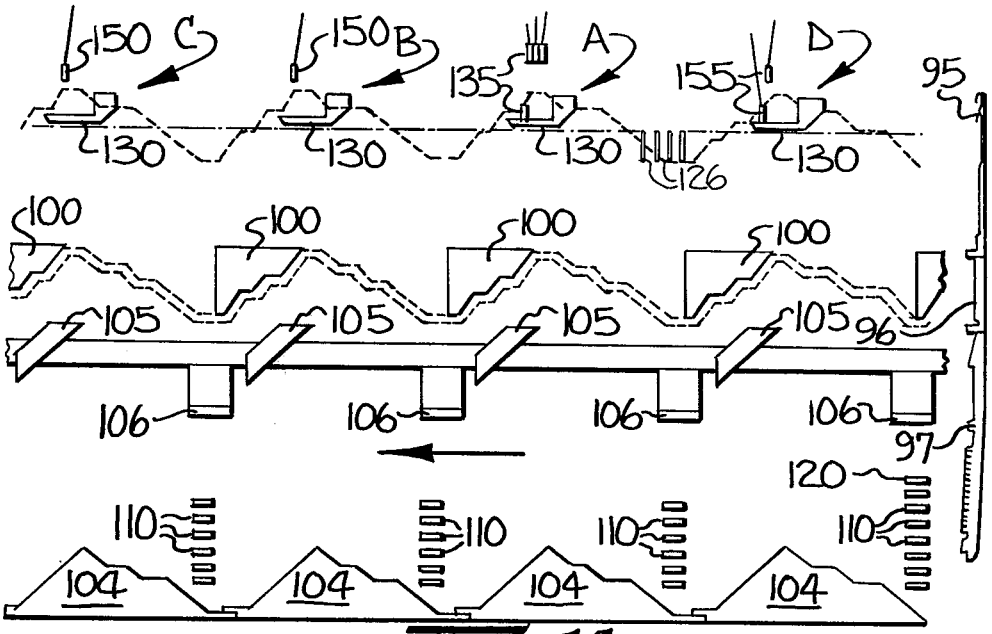
FIG. 14 is a developed view taken as if looking from the inside of the needle cylinder and illustrating the relationship of the four knitting stations surrounding one of the needle cylinders.

Each of the needle cylinders 20–13 is provided with the usual longitudinal extending slots which slideably support latch needles 95 (FIG. 14) intermediate jacks 96, and pattern jacks 97. As illustrated in the developed view of FIG. 14, each needle cylinder is surrounded by four knitting stations broadly indicated at A, B, C and D in FIG. 14. The knitting stations are each provided with a needle lowering stitch cam 100 supported for vertical adjustment on a support bracket 101 (FIG. 12) which is in turn fixed on a circular bed plate 102, surrounding the corresponding needle cylinder.

The needles 95 are selectively engaged and raised when corresponding pattern jacks 97 engage and are raised by selector jack raise cams 104 positioned in advance of each of the stitch cams 100. Pattern jack lowering cams or leveling cams 105 are supported at each of the knitting stations for engagement with the butts of the intermediate jacks 96 to lower the pattern jacks 97 to the proper level to be selected to either engage and ride up the raise cams 104 or to pass thereby without being raised. Pattern jack rocking cams 106 are supported beneath the bed plate 102 and are adapted to rock the lower ends of the pattern jacks 97 outwardly so that they will be properly positioned for selection, in a manner to be presently described.

Figure 11:
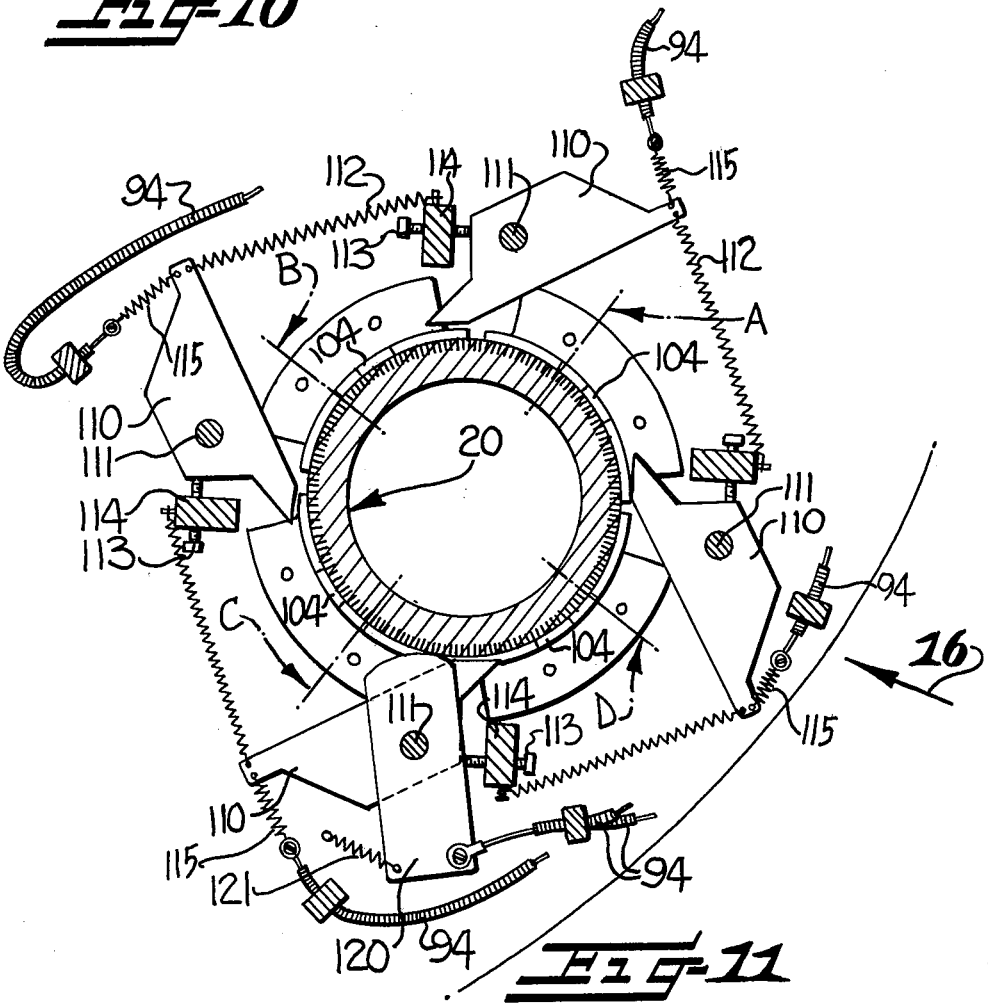
FIG. 11 is a sectional plan view through one of the needle cylinders and illustrating the needle selector levers positioned in advance of each of the knitting stations.

The positions of the four knitting stations are illustrated by the dash-dot lines A, B, C and D in FIG. 11 and needle selector means is provided in advance of each of these knitting stations. Each of these needle selector means includes a stack of selector levers 110 pivotally supported on a post 111 and normally urged to an outer or inoperative position by a tension spring 112. An adjustable stop screw 113 is provided for each of the selector levers 110 and is supported in a stop post 114.

A control cable 94 is connected at one end to the outer end of each of the selector levers 110 by a spring 115 so that when the lower end of the corresponding control lever 91 connected to the opposite end of the cable 94 is raised by a cam 90 on the pattern disc 24, the inner end of the selector lever 110 is moved inwardly, counterclockwise in FIG. 11, to be positioned to engage an operating butt at that level on the corresponding pattern jack 97. The corresponding pattern jack 97 is rocked inwardly at its lower end so that it is not raised by the next successive raise cam 104. Thus, the selector levers 110 provide a means to selectively control the operation of the needles at each knitting station so that the needles 95 may remain in a lowered or "float" level, be raised to an intermediate "tuck" level, or to be raised to the "clear" level to pick up the yarn and form stitch loops thereof at the corresponding knitting station.

In advance of the knitting station D, an extra pair of selector levers 120 (FIGS. 11 and 14) is supported on the pivot post 111 and above the regular selector levers 110 for purposes of selectively inlaying elastic yarn, in a manner to be presently described. The levers 120 are normally urged to an innermost active position by tension springs 121. One end of control cables 94 is connected to the levers 120 and the opposite ends are connected to corresponding control levers 91 so that the levers 120 may be moved outwardly to an inoperative position by cams 90 on the pattern disc 24.

Figure 13:
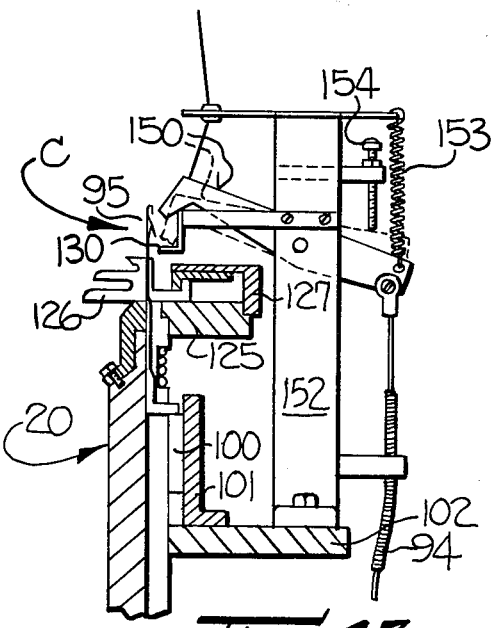
FIG. 13 is a view similar to FIG. 12 but being taken along the line 13—13 in FIG. 9 and illustrating the yarn feed finger at another knitting station.
Figure 15:
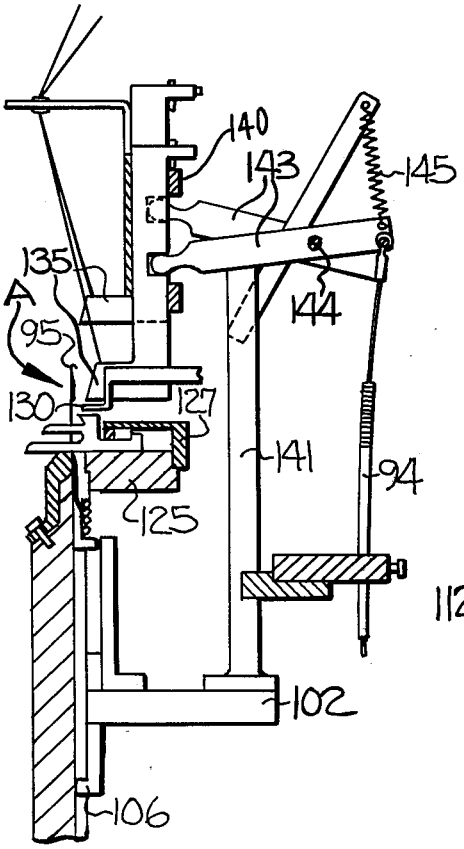
FIG. 15 is a view similar to FIGS. 12 and 13 but being taken substantially along the line 15—15 in FIG. 9 and illustrating the yarn feed fingers supported at the main knitting station.
Figure 16:
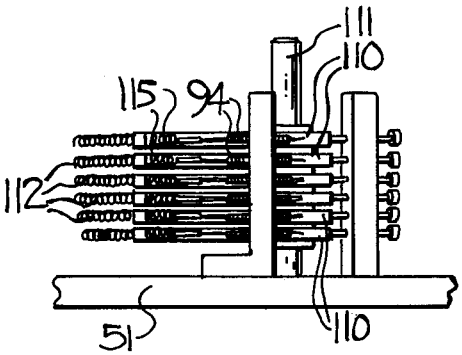
FIG. 16 is a fragmentary elevational view looking in the direction of the arrow 16 in FIG. 11 and illustrating the stacked selector levers in advance of the main knitting station.

A sinker bed 125 (FIGS. 12, 13 and 15) is fixed to the upper ends of each of the needle cylinders 20–23 and includes radial slots in which the usual sinkers 126 are supported for radial sliding movement. The sinkers 126 cooperate with the needles 95 in forming stitch loops, in the well-known manner. A sinker cap 127 is supported in a non-rotating position on the sinker bed 125 and includes the usual sinker control cams for controlling the radial positions of the sinkers 126. Each knitting station is provided with yarn feed fingers, to be presently described, which are selectively movable between operative and inoperative positions to selectively feed yarn to the needles 95. The inner ends of the yarn feed fingers are adapted to move into and out of operative position in throat plates 130 (FIG. 14) supported in fixed positions at each of the knitting stations.

At the main knitting station A, five yarn feed fingers 135 are supported for vertical sliding movement between the lowered operative position and the raised inoperative position in the throat plate 130. The yarn feed fingers 135 are supported for vertical sliding movement in a support bracket 140 (FIGS. 9 and 15) which is carried by support standards 141, the lower ends of which are fixed on the bed plate 102. Rocker levers 143 (FIG. 15) are pivotally supported intermediate their ends on a rock shaft 144 and their inner ends engage slots in the respective yarn feed fingers 135.

The outer ends of the rocker arms 143 are suitably attached to the upper ends of control cables 94 and the rocker arms 143 are normally urged in a counterclockwise direction so that the yarn feed fingers 135 are normally resiliently urged into the operative position by tension springs 145. When the opposite end of the control cable 94 is connected to a control lever 91 which is positioned on a cam 90, the inner end of the rocker arm 143 is raised so that the corresponding yarn feed finger 135 is raised to an inactive position. Thus, the yarn feed fingers at the main knitting station can be selectively controlled between operative and inoperative positions to feed various colors of yarn to the needles and the changing of the yarn feed fingers is under control of the cams 90 on the pattern disc 24.

At knitting stations B and C (FIG. 13) a single yarn feed finger 150 is movable between the lowered dotted line position and the raised solid line position relative to the throat plate 130 by means of the control cable 94 and the cams 90 on the pattern disc 24. The yarn feed finger 150 is pivotally supported intermediate its ends on a finger support stand 152 which is fixed at its lower end on the bed plate 102. The yarn feed finger 150 is normally urged into operative position by a tension spring 153 and the lower position of the yarn feed finger 150 is adjusted by an adjustment screw 154.

At the yarn feed station D, a pair of yarn feed fingers 155 is pivotally supported intermediate its end on a feed finger support post 156, the lower end of which is fixed on the bed plate 102. Control cables 94 are attached to the outer ends of the yarn feed fingers 155 and control the position of the feed fingers in the throat plate 130 between operative and inoperative position. Tension springs 157 normally urge the yarn feed fingers 155 to the lowered operative position and adjustment screws 158 are provided to adjust the lowered operative position of the yarn feed fingers 155 in the throat plate 130. A "button" type adjustable tension device 160 is illustrated as being supported at the station D (FIG. 12) for providing suitable tension on the yarn extending between the yarn package on the creel and one of the yarn feed fingers 155. This type of tension device is provided when an elastic yarn E is supplied to one of the yarn feed fingers 155. It is to be understood that suitable tension devices may also be provided for the other yarn feed fingers at each of the knitting stations at some location between the yarn supply packages and the yarn feed fingers.

Figure 9:
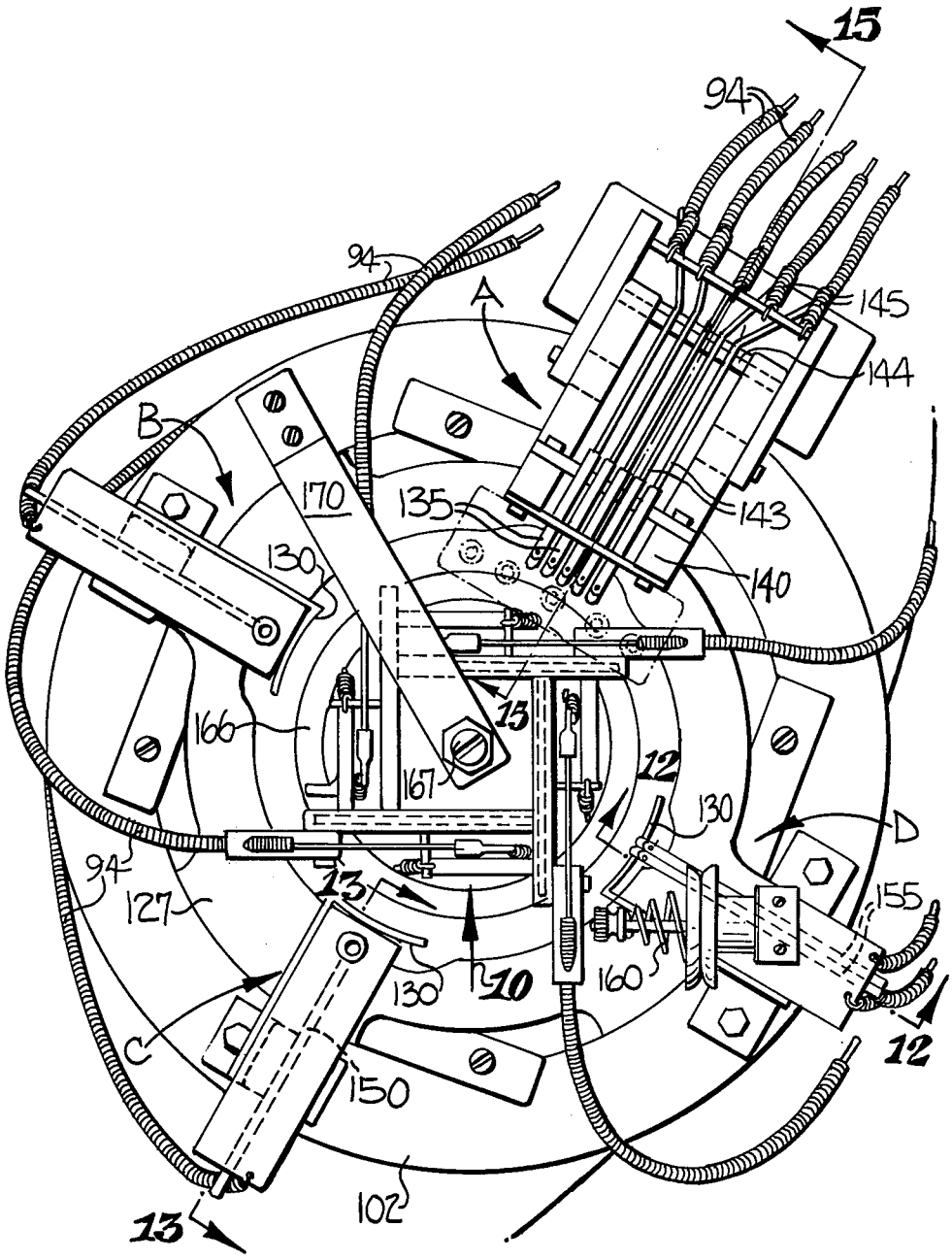
FIG. 9 is an enlarged fragmentary plan view looking down on one of the needle cylinders and showing the yarn feed fingers, yarn cutters and other parts associated therewith.
Figure 10:
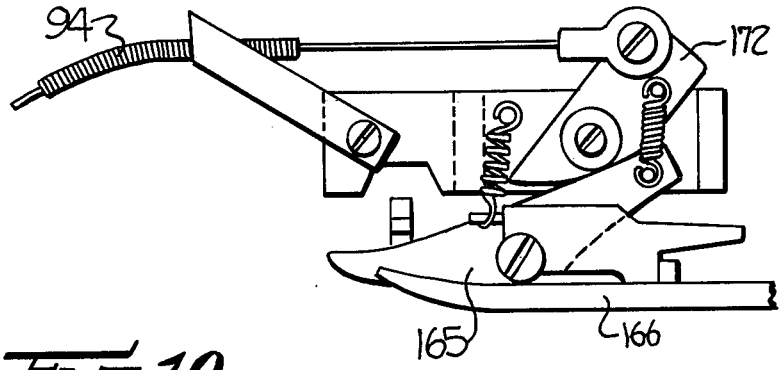
FIG. 10 is an enlarged fragmentary elevational view of one of the yarn cutting and clamping devices, looking in the direction of the arrow 10 in FIG. 9.

Any suitable type of yarn cutting and clamping device may be provided at each of the knitting stations. The cutting and clamping devices illustrated in the drawings each comprise a scissor type cutter and clamp 165 (FIG. 10) which is supported on a dial plate 166 positioned inside of the circle of needles and being supported on the lower end of a vertical post 167 (FIG. 9). The upper end of the post 167 is fixed in the inner end of a support bracket 170 having its outer end supported on the bed plate 102. The lower end of a cam lever 172 (FIG. 10) is adapted to engage the cutter 165 and its upper end is suitably connected to a control cable 94, the other end of which is connected to one of the control levers 91 above the pattern disc 24. Thus, the position of the cams 90 on the control pattern disc 24 also controls the operation of the cutting and clamping devices 165 in the proper timed relationship to the introduction and removal of the yarn feed fingers at each of the knitting stations A-D.

As the individual socks are knit at each needle cylinder, they are drawn down by suction in tubes 175 (FIG. 1), the upper ends of which are connected to the lower ends of the needle cylinders and the lower ends of which are connected to a common sock discharge tube 176, the free end of which is disposed above a sock collection receptacle 177. Suction is created in the tubes 175 by a blower 178 and the socks are blown out of the discharge tube 176 and into the receptacle 177. The machine operator can then collect the socks from the collection receptacle 177 and inspect the same for imperfections.

METHOD OF OPERATION

The machine will be described as knitting a tube type athletic sock with color bands positioned below the cuffs thereof. However, it is to be understood that other types of hosiery and other types of tubular articles can be knit on the present machine.

To begin the knitting of a sock on each of the cylinders 20–23, the rubber yarn feed finger 155 at station D is lowered to yarn feeding position and every other needle 95 is selected to be raised to the "tuck level" by the rubber selectors 120 so that the elastic yarn is interlaced on the needles in a one-by-one manner and during one or more revolutions of the needle cylinder. One of the main yarn feed fingers 135 feeding body yarn is then lowered to operative position at the main knitting station A and all needles 95 are raised to the clear level to pick up the body yarn and knit the same to complete the make-up of the sock.

The cuff of the sock is then knit by continuing to feed the body yarn at the main knitting station A by one of the fingers 135 and forming plain stitches on all of the needles while the selection of the elastic yarn at station D is changed to a one-by-three pattern so that the elastic yarn is floated inside of three needles and is inlaid in the fabric in the fourth needle wale to provide a mock rib cuff of the desired length. During the knitting of the make-up and the cuff, the cams 90 on the pattern disc 24 control the operation of the yarn feed fingers and also control the operation of the clamp and cutter 165 when the elastic yarn at station D is removed after formation of the cuff.

Various colored stripes may then be knit in the upper portion of the leg of the sock by changing the yarn feed fingers 135 at the main knitting station A to feed different colored body yarns to all of the needles after the desired number of courses have been knit with a body yarn of a particular color. In knitting the plain leg and tubular foot portion of the sock, body yarns may be fed to the needles at each of the knitting stations A-D so that four complete courses are formed with each rotation of the needle cylinder and all needles are selected to knit at each knitting station. Thus, four socks are simultaneously knitted on this machine and, during plain knitting, four courses of body yarn are knit with each rotation of each needle cylinder. The provision of four knitting stations provides the machine with various pattern possibilities since it is possible to knit plain courses at stations A, B and C while inlaying an elastic yarn at station D. Also, the needle selection at each knitting station makes it possible to knit various patterns of plain, tuck or float stitches at any of the knitting stations.

Because the cams 90 controlling the operation of each of the needle cylinders are in an easily accessible position surrounding the needle cylinders and on the upper surface of the pattern disc 24, it is easier to change patterns on the present machine than on the prior types of multiple needle cylinder machines where each needle cylinder is provided with its own particular pattern mechanism. The circular arrangement of the four needle cylinders also makes it easy to work on any particular needle cylinder from that respective side of the machine since access to that particular needle cylinder is unobstructed.

Since a sock is completed at each needle cylinder when the pattern disc has completed one-fourth of a rotation, it is possible to set up four different patterns on the pattern disc and successive socks knit at a particular needle cylinder will be provided with different patterns. If desired, the same pattern may be set up in each quadrant of the pattern disc, or two or three patterns may be set up in selected quadrants of the pattern disc.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. A knitting machine for simultaneously knitting a plurality of tubular articles, such as socks, and comprising (a) a plurality of needle cylinders each supported for rotation about a vertical axis, (b) drive means for simultaneously rotating said needle cylinders, (c) knitting means associated with each of said needle cylinders for producing a sock at each of said needle cylinders and including yarn feed means, and needle selector means, (d) a horizontally disposed pattern disc supported for rotation around said plurality of needle cylinders and including a central opening surrounding said plurality of needle cylinders, (e) drive means for imparting rotation to said pattern disc in timed relationship to rotation of said needle cylinders, (f) cam means supported in annular races on said horizontally disposed pattern disc, and (g) separate linkage means operatively associated with said yarn feed means and said needle selector means of each of said needle cylinders for controlling the operation thereof, said linkage means associated with said yarn feed means and said needle selector means of one of said needle cylinders being operable by said cam means at a first location, said linkage means associated with said yarn feed means and said needle selector means of another of said needle cylinders being operable by said cam means at a second location, and said second location being circumferentially spaced from said first location on said pattern disc.

2. A knitting machine according to claim 1 including (h) pattern control means operable by said needle cylinder drive means for selectively imparting step-by-step rotation to said pattern disc.

3. A knitting machine according to claim 1 including a horizontally disposed base plate on which said plurality of needle cylinders and said horizontally disposed pattern disc are supported for rotation.

4. A knitting machine according to claim 1 wherein said drive means for rotating said needle cylinders includes a main drive gear positioned in the center of said central opening in said horizontally disposed pattern disc, gear means fixed to each of said needle cylinders, and an intermediate drive gear associated with each of said needle cylinders and normally positioned in driving engagement with said main drive gear and with each of said needle cylinder drive gears for simultaneously rotating said needle cylinders, said intermediate drive gears being supported for easy removal so that rotation of selected ones of said needle cylinders may be discontinued while permitting the continued rotation of the remaining needle cylinders.

5. A knitting machine according to claim 4 including a horizontally disposed base plate on which said needle cylinders and said pattern disc are supported for rotation, and a generally circular support plate positioned in spaced relationship above and supported on said base plate, said support plate covering said main drive gear and including circular openings above said intermediate drive gears to permit removal of said intermediate drive gears.

6. A knitting machine according to claim 5 wherein said linkage means includes a bridging member fixed at one end on said base plate and adjacent each needle cylinder, each of said bridging members being fixed at the other end on said support plate so that the medial portion thereof extends above said horizontally disposed pattern disc, cam levers supported on said bridging member and including lower end portions positioned to engage said cam means supported in annular races on said horizontally disposed pattern disc, and operating linkage operatively connecting said cam levers with said yarn feed means and said needle selector means for operating the same in response to said cam means supported in annular races on said horizontally disposed pattern disc.

7. A knitting machine according to claim 2 wherein said drive means for imparting rotation to said pattern disc includes racking teeth on the outer periphery of said horizontally disposed pattern disc, a racking pawl supported adjacent and engageable with said racking teeth, and drive means for continuously reciprocating said pawl in timed relationship to rotation of said needle cylinders.

8. A knitting machine according to claim 7 wherein said pattern control means includes a pattern chain rotated in step-by-step movement in timed relationship to rotation of said needle cylinders, and racking pawl control means operated by said pattern chain for selectively moving said racking pawl into racking engagement with said racking teeth and for maintaining said racking pawl out of racking engagement with said racking teeth.

* * * * *